United States Patent [19]

Ampe et al.

[11] Patent Number: 4,947,898

[45] Date of Patent: Aug. 14, 1990

[54] WEFT THREAD SUPPLY VIA TWO ACCUMULATORS

[75] Inventors: Frank Ampe, Leffinge-Middelkerke; Jozef Verhulst, Zillebeke; Frans Wallegham, Passendale, all of Belgium

[73] Assignee: Picanol N.V., Belgium

[21] Appl. No.: 267,092

[22] Filed: Nov. 3, 1988

[30] Foreign Application Priority Data

Nov. 5, 1987 [BE] Belgium ..... 8701253

[51] Int. Cl.[5] ..... D03D 47/34

[52] U.S. Cl. ..... 139/452

[58] Field of Search ..... 139/435, 452

[56] References Cited

U.S. PATENT DOCUMENTS

| | | | |
|---|---|---|---|
| 3,675,687 | 7/1972 | Vermeulen et al. | 139/452 |
| 3,799,212 | 3/1974 | Stanislav et al. . | |
| 3,916,935 | 11/1975 | Keldany . | |
| 4,134,435 | 1/1979 | Cornellier | 139/435 |
| 4,673,004 | 6/1987 | Rosseel et al. . | |

FOREIGN PATENT DOCUMENTS

| | | | |
|---|---|---|---|
| 176987 | 9/1986 | European Pat. Off. . | |
| 867954 | 9/1981 | U.S.S.R. . | |
| 248150 | 6/1987 | U.S.S.R. | 139/452 |

*Primary Examiner*—Andrew M. Falik

*Attorney, Agent, or Firm*—Bacon & Thomas

[57] ABSTRACT

A method for supplying weft threads to the weft of a weaving machine includes the steps of leading the thread successively through two thread accumulators, one of which is a prewinder which at each insertion releases a length of thread equal to the thread length required, and the second of which is a thread accumulator which has a lower draw-off resistance than the prewinder, and which provides a thread accumulation consisting of at least a part of the length of thread released from the prewinder. An apparatus for implementing the above method includes the above-mentioned two accumulators and control means for controlling thread insertion nozzles and also a thread clip on the low-resistance accumulator which determines the beginning of insertion and a magnetic pin on the prewinder which controls the end of insertion.

9 Claims, 2 Drawing Sheets

WEFT THREAD SUPPLY VIA TWO ACCUMULATORS

BACKGROUND OF THE INVENTION

The invention concerns a method for preparing a weft thread on weaving machines, i.e. a method for presenting weft threads of a particular length intermittently to a thread insertion mechanism, so that on each weaving cycle a particular length of weft thread is inserted into the shed of the weaving machine. The invention also concerns a weaving machine equipped to use this method.

A known method of providing a particular length of weft thread on each weaving cycle is to wind weft threads during a prewinder, and at each insertion to release a certain number of windings from said prewinder, as known from amongst other U.S. Pat. No. 4,673,004 of the present applicant.

Such prewinders however have the disadvantage that the force necessary to draw the weft thread from the prewinder drum is relatively high, so that there is a high tension on the thread during its insertion into the shed, and also the disadvantage that the thread is braked during its insertion into the shed, so that the speed with which the thread is inserted into the shed is limited.

Another known of providing weft threads is to use a weft accumulator in which the weft thread is laid against a wall. An example is a thread accumulator in which the weft thread is laid spirally against the inside wall of a tube by means of a blower nozzle, after which lengths of weft thread can be drawn intermittently from said tube. The adjustment for releasing exactly one length of weft thread each time is obtained by means of e.g. a thread clip and suitably-controlled thread feed rollers, such that, as known from Dutch patent application No. 86.02741 of the present applicant, which corresponds to U.S. Pat. No. 4,821,781, the correct length of thread is released by the thread feed rollers at the moment the thread clip is closed.

Although such a weft accumulator mechanism has the advantage that the resistance that has to be overcome in order to draw the weft thread from the tube is very low, it has the disadvantage that very precise control of the above-mentioned thread feed rollers and thread clip are necessary in order to release exactly one length of weft thread.

SUMMARY OF THE INVENTION

The present invention has as its aim to provide a method for preparing a weft thread on weaving machines which systematically avoids the above-mentioned disadvantages. For this purpose the invention concerns a method which includes the steps of leading the weft thread successively through two thread accumulators, in particular first through a prewinder which at each insertion releases a length of thread equal to the thread length required, and then through a thread accumulator which has a lower draw-off resistance than that of the prewinder, where said accumulator provides a thread accumulation consisting of at least part of said length released.

In a preferred embodiment, the second thread accumulator is of the type in which the weft thread is laid spirally against the inside wall of a tube by means of a blower nozzle.

As a result of using the method according to the invention, the first section of weft thread is taken from the accumulation in the second thread accumulator, while the last section of weft thread is taken from the prewinder. This method has the particular advantage that the first section of thread can be inserted into the shed by the thread insertion device with very low draw-off resistance, so that there is very little braking of the thread, thus enabling it to be insert into the shed with very high speed. Once all of the accumulation from the second thread accumulator has been inserted into the shed, the remaining required length of thread can be drawn directly from the prewinder. This in turn has the advantage that the length of thread can be controlled by means of the magnetic pin of the prewinder, and also that because of the higher resistance to which the thread is subjected as it is drawn off the prewinder, the weft thread can be braked gradually at the end of the insertion, so that the chance of a thread break at the end of the insertion is relatively small.

BRIEF DESCRIPTION OF THE DRAWINGS

In order to explain the characteristics of the invention, by way of example only and without being limitative in any way, the method of the invention is described below, with reference to the accompanying drawings.

DETAILED DESCRIPTION OF THE PREFERRED EMBODIMENT

Figure 1:
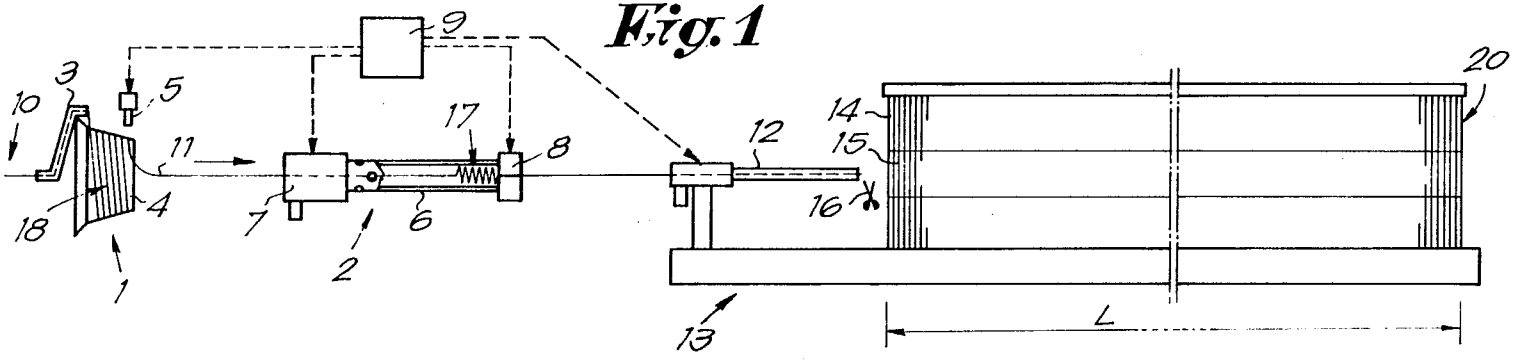
FIGS. 1–5 illustrates successive steps of a preferred embodiment of the invention, in connection with a schematic diagram of a preferred apparatus for carrying out the invention.

As shown in FIG. 1, the invention essentially uses a combination of two thread accumulators, for example a prewinder 1 which on each insertion release one length of thread, thus determining the insertion length, followed in the direction of motion of the thread by a tube-shaped thread accumulator 2, which partly takes up said length (i.e. up to a maxmium of one insertion length) and which determines the draw-off resistance. Th prewinder 1 used here includes, as is known, a winding arm 3 and a prewinder drum 4 which can rotate with respect to each other. Along the prewinder drum 4 there is a magnetic pin 5 which determines the end of insertion of the weft thread and which controls the number of windings released. Additional pins 5 may also be included along the circumference of the prewinder 1. The tube-shaped thread accumulator 2 consists essentially of a perforated tube 6 with a blower nozzle 7 before it and a thread clip 8 after it, where said thread clip determines the beginning of the insertion. In order to carry out the method according to the invention, both thread accumulator devices 1 and 2 and in particular the magnetic pin 5 and the thread clip 8 are suitably controlled by means of a control unit 9, as described below. The pin 5 and/or the clip 8 may be operated electromagnetically.

Finally, FIG. 1 also shows a number of other components, namely the thread supply 10, taken from e.g. a supply package (not shown), the weft thread 11, a thread insertion mechanism such as a main nozzle 12, the sley 13, the reed 14, the shed 15 and a cutter 16.

The aim of the method according to the invention is to insert the correct length L of weft thread into the shed at each weaving cycle. This is achieved preferably as described below.

In FIG. 1 a thread accumulation 18 is being continuously formed on the prewinder 1. Since the magnetic pin 5 is open, the weft thread 11 is also being led from the prewinder 1 into the tube 6. Note that the thread clip 8 remains closed at this stage, thus forming a thread accumulation 17.

Figure 2:
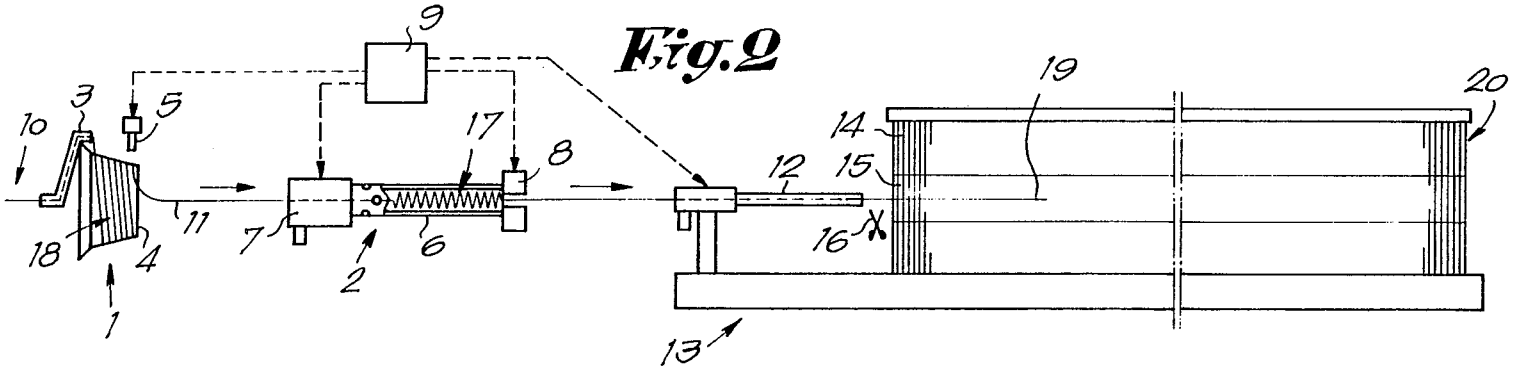

The thread clip 8 is then opened, as shown in FIG. 2, so that insertion of the weft thread 11 into the shed 15 begins.

Figures 3, 4, 5:
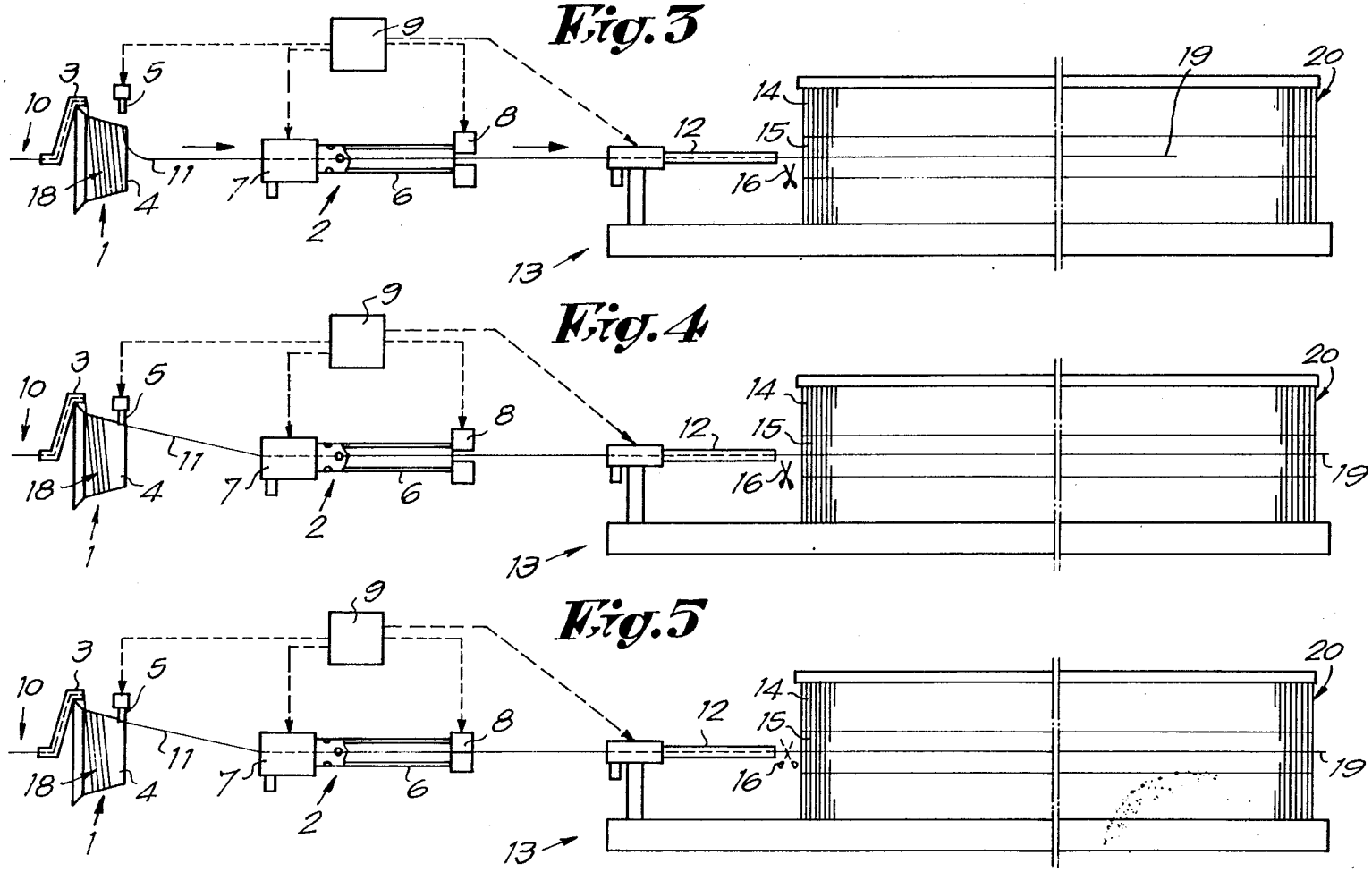

During insertion of the weft thread 11 the state shown in FIG. 3 is reached, in which the weft thread 11 stretches in a taut condition through the weft accumulator 2 and in which the leading end of the thread 19 is still a little way from the receiving side of the shed 15. As a direct result, the last section of the weft thread 11 is taken directly form the prewinder 1. This results in a gradual decrease in the velocity of the weft thread 11, since the prewinder 1 has greater draw-off resistance, which is favorable at the end of insertion.

At the moment the number of windings corresponding to the above-mentioned insertion length L has been released, the magnetic pin 5 is closed, as shown in FIG. 4, with the result that the leading end 19 is located at the end of the shed 20 and the required insertion length L is inserted.

By then closing the thread clip 8 once more, as shown in FIG. 5, and opening the magnetic pin 5 a new thread accumulation 17 can be started in the tube 6, so returning once more to the state shown in FIG. 1.

Clearly, in this way all the advantages mentioned in the preamble are obtained, namely that precise control of the thread clip 8 is not necessary and that the weft thread 11 is inserted into the shed 15 essentially with very low draw-off resistance.

During the operation of the method according to the invention the magnetic pin 5 determines the end of the weft insertion while the thread clip 8 determines the beginning of this insertion.

The relative positions of the magnetic pin 5 and the thread clip 8 are successively as follows:

thread clip 8 closed—magnetic pin 5 closed
thread clip 8 closed—magnetic pin 5 open
thread clip 8 open—magnetic pin 5 open
thread clip 8 open—magnetic pin 5 closed
thread clip 8 closed—magnetic pin 5 closed.

For the sake of completeness, it should also be noted that in an exemplary embodiment the blower nozzle 7 only operates when the magnetic pin 5 is opened. The blower nozzle 7 will in any case cease to operate just before the magnetic pin 5 closes. The main injector nozzle 12 operates either as soon as the thread clip 8 opens, or from slightly before the thread clip 8 opens until the magnetic pin 5 closes or until slightly before or after the magnetic pin 5 closes. The cutter 16 cuts the weft thread 11 slightly after the thread clip 8 closes, for example.

As is apparent from the above description, control unit 9 controls the respective elements as follows: First, thread clip 8 is opened to begin the insertion. Nozzle 12 is activated either at the same time or shortly before the thread clip is opened, and remains open until magnetic pin 5 closes. Magnetic pin 5 closes after a predetermined length of thread has been wound off the accumulator.

Nozzle 7 operates when magnetic pin 5 is opened in order to assist with insertion and also to preload the accumulator 2. Magnetic pin 5 opens before thread clip 8 opens in order to preload the accumulator and magnetic pin 5 remains open until the predetermined length of thread has been wound off the accumulator, at which time it stops insertion by closing, and remains closed until thread clip closes, after which it is opened again to allow preloading of the accumulator 2.

Consequently, it will be appreciated by those skilled in the art that control of the activation of the various elements 5, 7, 8 and 12 is essentially a matter of timing. No additional means indicating the completing of picking is required, except in so far as magnetic pin 5 must be made to close after an appropriate number of revolutions of thread have left the accumulator. Means for controlling the number of revolutions of thread which are wound off an accumulator are described in U.S. Pat. No. 4,673,004.

In the same manner as described in, for example, column 2, lines 59 et seq. of U.S. Pat. No. 4,673,004, magnetic pin 5 as described above normally prevents the thread from winding off the accumulator drum. When pin 5 is opened, thread is free to wind off the drum until the pin is once again caused to close, at which time the thread continues winding off the drum along it circumference until it reaches the point at which the pin blocks further movement and catches there, thus stopping the winding off after a predetermined number of revolutions.

Although pin 5 controls the number of revolutions, and therefore the length of thread which winds off the accumulator, thread clip 8 determines the beginning of insertion because, even when magnetic pin 5 is open, thread cannot be inserted until the thread clip is opened. On the other hand, as decribed above, even though thread clip 8 is open, accumulation stops when magnetic pin 5 after a predetermined length of thread has been wound off the drum.

The present invention is not limited to the embodiment described by way of example and shown in the drawings; on the contrary, such a method can be carried out according to different variants, while still remaining within the scope of the invention.

We claim:

1. A method for supplying weft thread to be inserted into the shed of a weaving machine, comprising the steps of leading the weft thread from a thread supply successively through two thread accumulators, intermittently releasing from said first one of said accumulators, at an insertion, a length of thread equal to the insertion length; accumulating said thread in the second accumulator; beginning insertion of thread into the shed by drawing off the thread accumulated in said second accumulator; when said thread accumulated in said second accumulator is drawn off, continuing the insertion by drawing off thread from the first accumulator until a predetermined length equal to the insertion length has been inserted into the shed, wherein said second accumulator has a lower draw-off resistance than said first accumulator, and wherein the beginning of the insertion is determined by said second accumulator and the end of the insertion is determined by said first accumulator.

2. A method as claimed in claim 1, wherein the step of leading the weft thread through the second thread accumulator includes the step of laying said thread spirally against the inside wall of a tube in said second accumulator by means of a blower nozzle.

3. A method as claimed in claim 1, wherein the thread accumulated in the second thread accumulator is less than the thread length released by the first accumulator for one insertion.

4. A method as claimed in claim 1, wherein the beginning of insertion is determined by opening a thread clip on said second accumulator.

5. A method as claimed in claim 1, wherein the end of insertion is determined by closing a magnetic pin on said first accumulator.

6. A method as claimed in claim 1, wherein said first accumulator is a prewinder of the type in which thread is released during each insertion by opening a magnetic pin and drawing off the thread by means of a blower nozzle.

7. A method a claimed in claim 1, wherein said step of releasing the thread from the first accumulator includes the steps of causing a magnetic pin in the first accumulator to release said thread from a prewinder drum, and wherein the step of beginning insertion includes the step of opening a thread clip in the second accumulator to release said thread from said second accumulator, and wherein the insertion is carried out by a main nozzle, the method therefore consisting of the following successive steps on each weaving cycle: keeping the magnetic pin open and the thread clip closed, so that a thread accumulation is formed in the second thread accumulator, opening said thread clip at the beginning of thread insertion into the shed, closing the magnetic pin at the moment the predetermined length of thread has been released from the first accumulator, and closing said thread clip so that the complete cycle can begin once more by causing the magnetic pin on the prewinder to reopen.

8. An apparatus for supplying a weft thread to the shed of a weaving machine, comprising two thread accumulators in series, said first thread accumulator including means for determining the insertion length, said insertion length determining means incluing a prewinder comprising a prewinder drum on which the thread is wound by means of a winding arm and released by means of a magnetic pin, and the second thread accumulator comprising an accumulator tube in which the weft thread is laid against a wall by means of a blower nozzle which draws said released windings from said prewinder drum, and which at the end of the accumulator tube which faces the shed, includes menas comprising a thread clip for determining the beginning of insertion.

9. A weaving machine as claimed in claim 8, wherein the second accumulator tube includes means for laying the weft thread sprially therein.

* * * * *